US007522138B2

(12) United States Patent
Lee et al.

(10) Patent No.: US 7,522,138 B2
(45) **Date of Patent: *Apr. 21, 2009**

(54) DISPLAY DEVICE WITH REDUCED FLICKERING

(75) Inventors: Seung-Woo Lee, Seoul (KR); Moung-Su Kim, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 584 days.

This patent is subject to a terminal disclaimer.

(21) Appl. No.: 10/912,275

(22) Filed: Aug. 4, 2004

(65) Prior Publication Data

US 2005/0062702 A1 Mar. 24, 2005

(30) Foreign Application Priority Data

Aug. 6, 2003 (KR) ..... 10-2003-0054318

(51) Int. Cl.
*G09G 3/36* (2006.01)

(52) U.S. Cl. ..... 345/89; 345/690

(58) Field of Classification Search ..... 345/89, 345/87, 690–693

See application file for complete search history.

(56) References Cited

U.S. PATENT DOCUMENTS

| | | | | |
|---|---|---|---|---|
| 6,459,416 | B1 * | 10/2002 | Sasaki et al. | 345/89 |
| 6,995,743 | B2 * | 2/2006 | Boer et al. | 345/104 |
| 2001/0038372 | A1 | 11/2001 | Lee | |
| 2002/0050965 | A1 | 5/2002 | Oda et al. | |
| 2002/0140652 | A1 | 10/2002 | Suzuki et al. | |
| 2003/0048245 | A1 | 3/2003 | Ham | |
| 2003/0080983 | A1 | 5/2003 | Someya et al. | |

* cited by examiner

*Primary Examiner*—Ricardo L Osorio
(74) *Attorney, Agent, or Firm*—Haynes and Boone, LLP

(57) ABSTRACT

An LCD device is provided with an image signal modifier to reduce wire frame flickering. The image signal modifier monitors image signals and outputs modified image signals to a data driver for application to data lines and pixels in the LCD device. The image signal modifier retrieves modified signals from a set of predetermined modified signal values stored a lookup table. The image signal modifier performs calculations to interpolate between the predetermined modified signal values. The predetermined modified signal values are predetermined empirically as modified signal values that reduce wire frame flickering.

19 Claims, 7 Drawing Sheets

DISPLAY DEVICE WITH REDUCED FLICKERING

RELATED APPLICATION

This application claims priority, under 35 USC § 119, from Korean Patent Application No. 2003-0054318 filed on Aug. 6, 2003, which is incorporated by reference herein in its entirety.

BACKGROUND OF THE INVENTION

1. Field of the Invention

The present invention relates generally to display devices and particularly to a method of modifying image signals in the devices.

2. Description of Related Art

A liquid crystal display (LCD) includes a pair of panels with field generating electrodes and a liquid crystal layer with dielectric anisotropy disposed between the two panels. An electric field is formed in the liquid crystal layer using the electrodes, and the transmittance of light passing through the liquid crystal layer is adjusted by controlling the electric field, thereby obtaining the desired images.

A pair of electrodes that generate electric field in cooperation with each other and the liquid crystal layer disposed therebetween form a liquid crystal capacitor. The strength of the electric field applied to the liquid crystal layer can be controlled by adjusting the voltage across the liquid crystal capacitor. The application of the voltage across the liquid crystal capacitor is performed by scanning for a given time.

However, the response time of liquid crystal molecules in reaction to the applied electric field is long. Thus, sometimes, it takes time for the liquid crystal capacitor to charge to a target voltage, with the exact time depending on the difference between the previous voltage and the target voltage. When the difference between the target voltage and the previous voltage is large, the liquid crystal capacitor may not reach the target voltage for a long time.

One of the solutions suggested for addressing the problem of long liquid crystal layer charge time is dynamic capacitance compensation (DCC). The DCC method entails applying a voltage that is higher than a target voltage to the liquid crystal capacitor to take advantage of fact that the response time decreases as the voltage across the liquid crystal capacitor increases. To determine the modified voltage that is applied to the liquid crystal capacitor, the DCC method converts digital image signals to analog voltages by using a lookup table. The lookup table stores the values that can be used to determine the modified voltage. One disadvantage with the lookup table is that if it is large, it could result in an increased size of the display device. Thus, the size of the lookup table needs to be small to maintain the compactness of the LCD.

FIG. 1 is an illustration of an exemplary wire frame created by using a computer aided design (CAD) program and shown on an LCD screen. A wire frame is a set of line segments representing a three dimensional object. The exemplary wire frame of FIG. 1 represents a kettle. Sometimes, when the wire frame is moved on the screen or zoomed in or out, some flickering is seen on the screen. This flickering phenomenon, called "wire frame flickering," is particularly severe in a patterned vertically aligned (PVA) mode LCD having cutouts at the field generating electrodes.

As the wire frame flickering phenomenon compromises display quality, an improved display quality can be achieved by reducing the phenomenon.

SUMMARY OF THE INVENTION

In one aspect, the invention is a method of reducing flickering in a display device. The method includes determining a previous image's gray signal $g_{N-1}$, determining a current image's gray signal $g_N$, and selecting a modified signal $g'_N$ from a set of predetermined modified signal values by using $g_{N-1}$ and $g_N$. Each of the predetermined modified signal values may be selected for a range of $g_{N-1}$ and $g_N$. The modified signal $g'_{N-1}$ is applied to data lines in the display device.

In another aspect, the invention is a method of reducing flickering in a display device by determining a previous image's gray signal $g_{N-1}$ and a current image's gray signal $g_N$, and selecting a modified signal $g'_N$ from a set of predetermined modified signal values by using $g_{N-1}$ and $g_N$. The $g'_N$ is larger than $g_N$ when $g_N > g_{N-1}$. The modified signal $g'_N$ is applied to data lines in the display device.

In yet another aspect, the invention is a display device that includes a display panel having pixels defined by data lines and gate lines, an image signal modifier, and a data driver for applying the modified signal $g'_N$ to the data lines. The image signal modifier receives a previous image's gray signal $g_{N-1}$ and a current image's gray signal $g_N$, and selects a modified signal $g'_N$ from a set of predetermined modified signal values by using $g_{N-1}$ and $g_N$. Each of the predetermined modified signal values in the set may be selected for a range of $g_{N-1}$ and $g_N$.

DETAILED DESCRIPTION OF THE PREFERRED EMBODIMENTS

Figure 1:
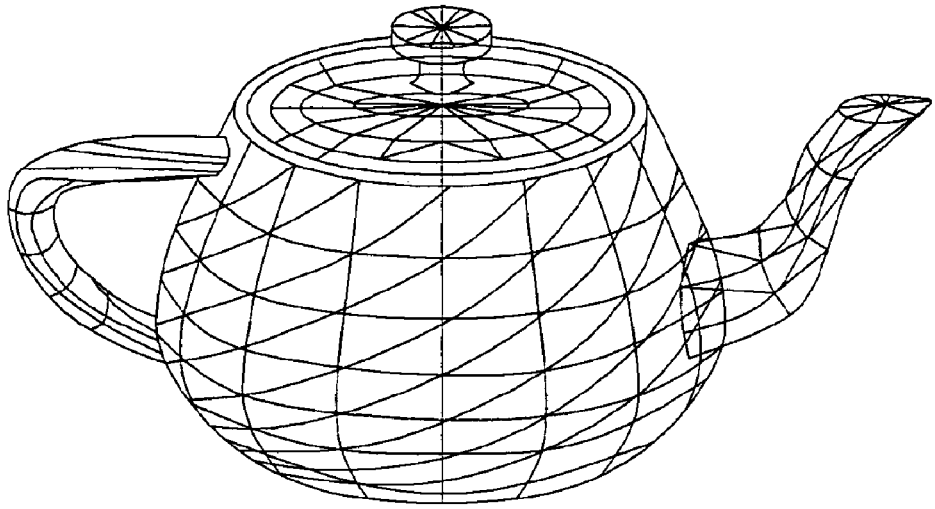
FIG. 1 illustrates a wire frame representation of a kettle displayed on an LCD device.

The present invention will now be described in more detail with reference to the accompanying drawings, in which preferred embodiments of the invention are shown. This invention may, however, be embodied in many different forms and should not be construed as being limited to the embodiments set forth herein.

In the drawings, the thickness of layers and regions are exaggerated for clarity. Like numerals refer to like elements.

Now, liquid crystal displays and methods of modifying image signals will be described in detail with reference to the accompanying drawings.

Figure 2:
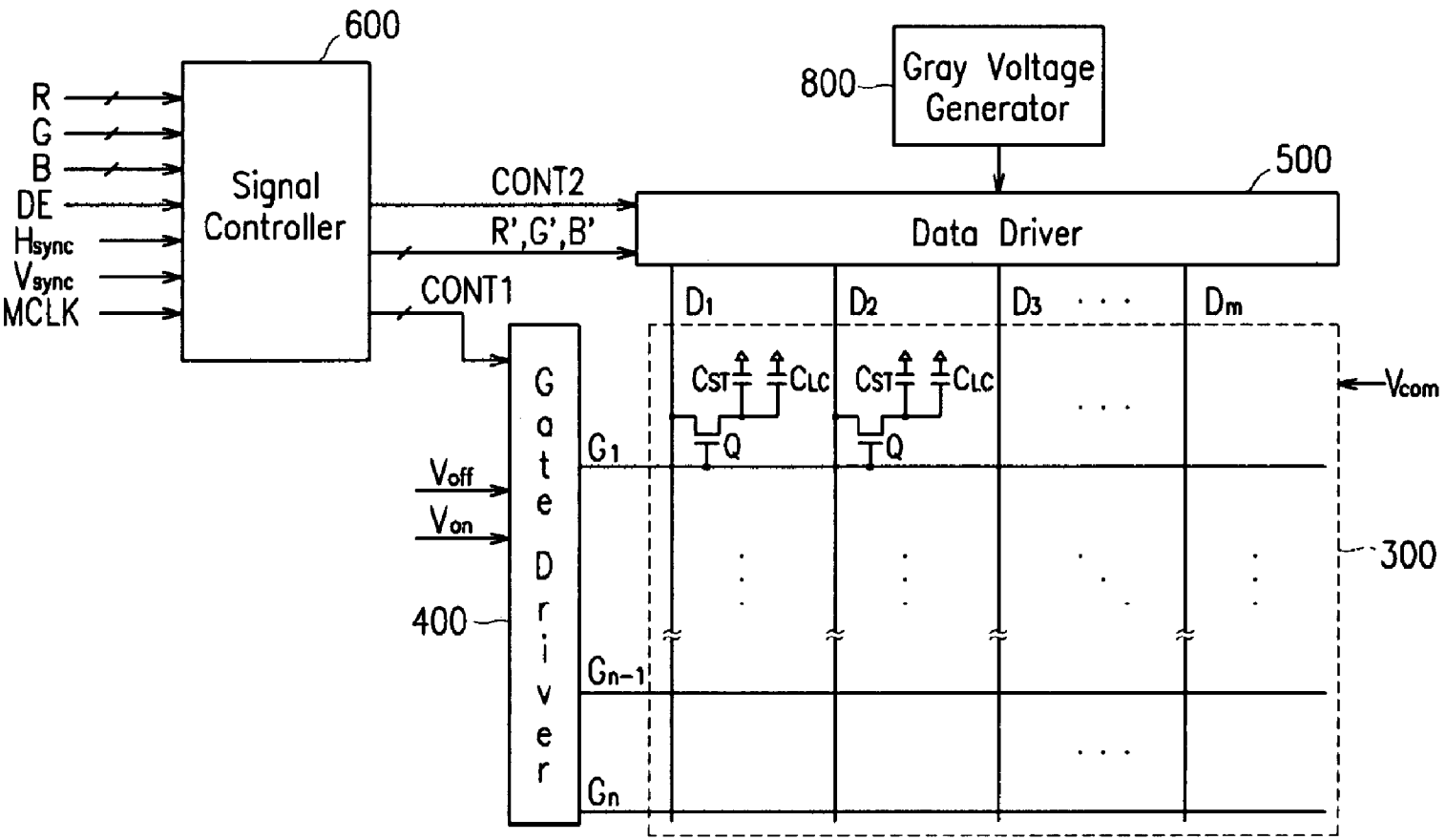
FIG. 2 is a block diagram of an LCD device according to an embodiment of the present invention.
Figure 3:
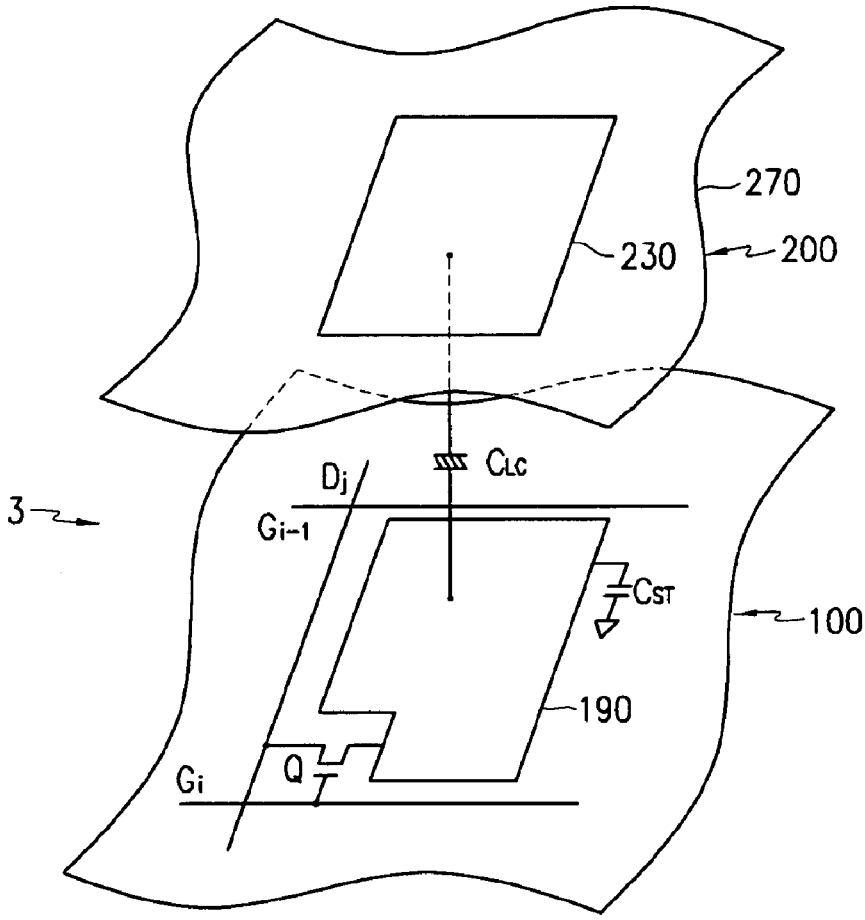
FIG. 3 is an equivalent circuit diagram of a pixel of an LCD according to an embodiment of the present invention.

FIG. 2 is a block diagram of an LCD device according to an embodiment of the present invention, and FIG. 3 is a circuit diagram of a pixel of an LCD device according to an embodiment of the present invention.

In FIG. 2, the depicted LCD device includes a liquid crystal (LC) panel assembly 300, a gate driver 400, and a data driver 500 that are connected to the panel assembly 300, a gray voltage generator 800 connected to the data driver 500, and a signal controller 600 controlling the gate driver 400 and the data driver 500. In circuital view, the panel assembly 300 includes a plurality of display signal lines $G_1$-$G_n$ and $D_1$-$D_m$ and a plurality of pixels connected thereto and arranged substantially in a matrix.

The display signal lines $G_1$-$G_n$ and $D_1$-$D_m$ include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially parallel to one another. The data lines $D_1$-$D_m$ extend substantially in a direction that is substantially perpendicular to the direction in which the gate lines $G_1$-$G_n$ extend, and are also substantially parallel to one another. The gate lines $G_1$-$G_n$ and the data lines $D_1$-$D_m$ define the pixels of the panel assembly 300.

Each pixel includes a switching element Q connected to one of the gate lines $G_1$-$G_n$ and one of the data lines $D_1$-$D_m$, and a LC capacitor $C_{LC}$ and a storage capacitor $C_{ST}$ that are connected to the switching element Q. The storage capacitor $C_{ST}$ may be omitted in some embodiments.

The switching element Q is provided on a lower panel 100 and it has three terminals: a control terminal connected to one of the gate lines $G_1$-$G_n$; an input terminal connected to one of the data lines $D_1$-$D_m$; and an output terminal connected to both the LC capacitor $C_{LC}$ and the storage capacitor $C_{ST}$.

As shown in FIG. 3, the LC capacitor $C_{LC}$ includes a pixel electrode 190 provided on the lower panel 100 and a common electrode 270 provided on an upper panel 200. The pixel electrode 190 and the common electrode 270 act as two terminals for generating an electric field in the LC layer. The LC layer 3 disposed between the two electrodes 190 and 270 functions as the dielectric of the LC capacitor $C_{LC}$. The pixel electrode 190 is connected to the switching element Q and the common electrode 270 is connected to the common voltage $V_{com}$ and covers the entire surface of the upper panel 200. In other embodiments, the common electrode 270 may be provided on the lower panel 100. The pixel electrodes 190 and the common electrode 270 are not limited to the shapes shown in FIG. 3.

The storage capacitor $C_{ST}$ is defined by the overlap of the pixel electrode 190 and a separate wire (not shown) provided on the lower panel 100, where a predetermined voltage such as the common voltage $V_{com}$ is applied to the separate wire. Alternatively, the storage capacitor is defined by the overlap of the pixel electrode 190 and its previous gate line $G_{i-1}$ with an insulating layer therebetween.

For a color display, each pixel can represent a color by using a red, green, or blue color filter 230 overlying the pixel electrode 190. The color filter 230 shown in FIG. 3 is provided in the upper panel 200. In other embodiments, the color filters 230 are provided on or under the pixel electrode 190 on the lower panel 100.

One or more polarizers (not shown) are attached to at least one of the panels 100 and 200 to polarize the light.

Referring again to FIG. 2, the gray voltage generator 800 generates two sets of gray voltages relating to the transmittance of the pixels. The gray voltages in one set have a positive polarity with respect to the common voltage Vcom, while those in the other set have a negative polarity with respect to the common voltage Vcom. The common voltage Vcom is the voltage that is applied to the common electrode 270.

The gate driver 400 is connected to the gate lines $G_1$-$G_n$ of the panel assembly 300 and applies gate signals from an external device to the gate lines $G_1$-$G_n$. The gate signal is a combination of a gate-on voltage Von and a gate-off voltage Voff.

The data driver 500 is connected to the data lines $D_1$-$D_m$ of the panel assembly 300 and selects gray voltages from the gray voltage generator 800 to apply to the data lines $D_1$-$D_m$ as data signals.

The gate driver 400 or the data driver 500 may include a plurality of driver integrated circuit (ICs) that are mounted directly on the panel assembly 300 or mounted on flexible printed circuit films to form tape carrier packages attached to the panel assembly 300. Alternatively, the gate driver 400 or the data driver 500 may be integrated into the panel assembly. The signal controller 600 controls the gate driver 400 and the data driver 500.

Now, the operation of the LCD will be described in detail.

The signal controller 600 receives, from an external graphic controller (not shown), input image signals R, G and B and input control signals controlling the display thereof. The control signals include a vertical synchronization signal Vsync, a horizontal synchronization signal Hsync, a main clock signal MCLK, a data enable signal DE, etc. The signal controller 600 modifies the input image signals R, G and B based on the operating condition of the panel assembly 300 and generates modified image signals R', G' and B' for the data driver 500. Moreover, the signal controller 600 generates a plurality of gate control signals CONT1 and data control signals CONT2 on the basis of the input image signals and the input control signals and it provides the gate control signals CONT1 for the gate driver 400 and the data control signals CONT2 for the data driver 500. The modification of the image signals will be described later in detail.

The gate control signals CONT1 include a scanning start signal STV for instructing to start the scanning of the gate-on voltage Von and at least a clock signal for controlling the output timing of the gate-on voltage Von.

The data control signals CONT2 include a horizontal synchronization start signal STH for informing of data transmission for a pixel row, a load signal LOAD or TP for instructing to apply the data voltages to the data lines $D_1$-$D_m$, an inversion control signal RVS for reversing the polarity of the data voltages (with respect to the common voltage Vcom), and a data clock signal HCLK.

The data driver 500 receives a packet of the image data R', G' and B' for a pixel row from the signal controller 600. The data driver 500 converts the image data R', G' and B' into analog data voltages selected from the gray voltages from the gray voltage generator 800 and applies the data voltages to the data lines $D_1$-$D_m$ in response to the data control signals CONT2 from the signal controller 600.

Responsive to the gate control signals CONT1 from the signal controller 600, the gate driver 400 applies the gate-on voltage Von to the gate line $G_1$-$G_n$, thereby turning on the switching elements Q connected thereto. The data voltages applied to the data lines $D_1$-$D_m$ are supplied to the corresponding pixels via the turned-on switching elements Q.

By repeating this procedure by a unit of a horizontal period (which is also denoted by "1H" equal to one period of the horizontal synchronization signal Hsync and the data enable signal DE), all gate lines $G_1$-$G_n$ are sequentially supplied with the gate-on voltage Von during a frame. This way, the data voltages are applied to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing through a data line in one frame are reversed (e.g., line inversion and point inversion), or the polarity of the data voltages in one packet are reversed (e.g., column inversion and point inversion).

According to an embodiment of the present invention, modifying the image signals by the signal controller 600 entails modifying image signals based on both an image signal of a current frame (hereinafter referred to as the "current image signal") and an image signal of a previous frame (hereinafter referred to as the "previous image signal") to compensate for the response time of liquid crystal and to prevent wire frame flicker. In particular, the current image signal is modified to have an increased value if the previous image signal is larger than the current image signal.

A plurality of variables required for the modification of the current image signal are first determined by using the most significant bits (MSBs) of the previous image signal and the current image signal, and then the modified image signal is calculated by using the variables and the least significant bits (LSBs) of the previous image signal and the current image signal.

Now, the signal modification of the signal controller will be described more in detail with reference to FIG. 4.

Figure 4:
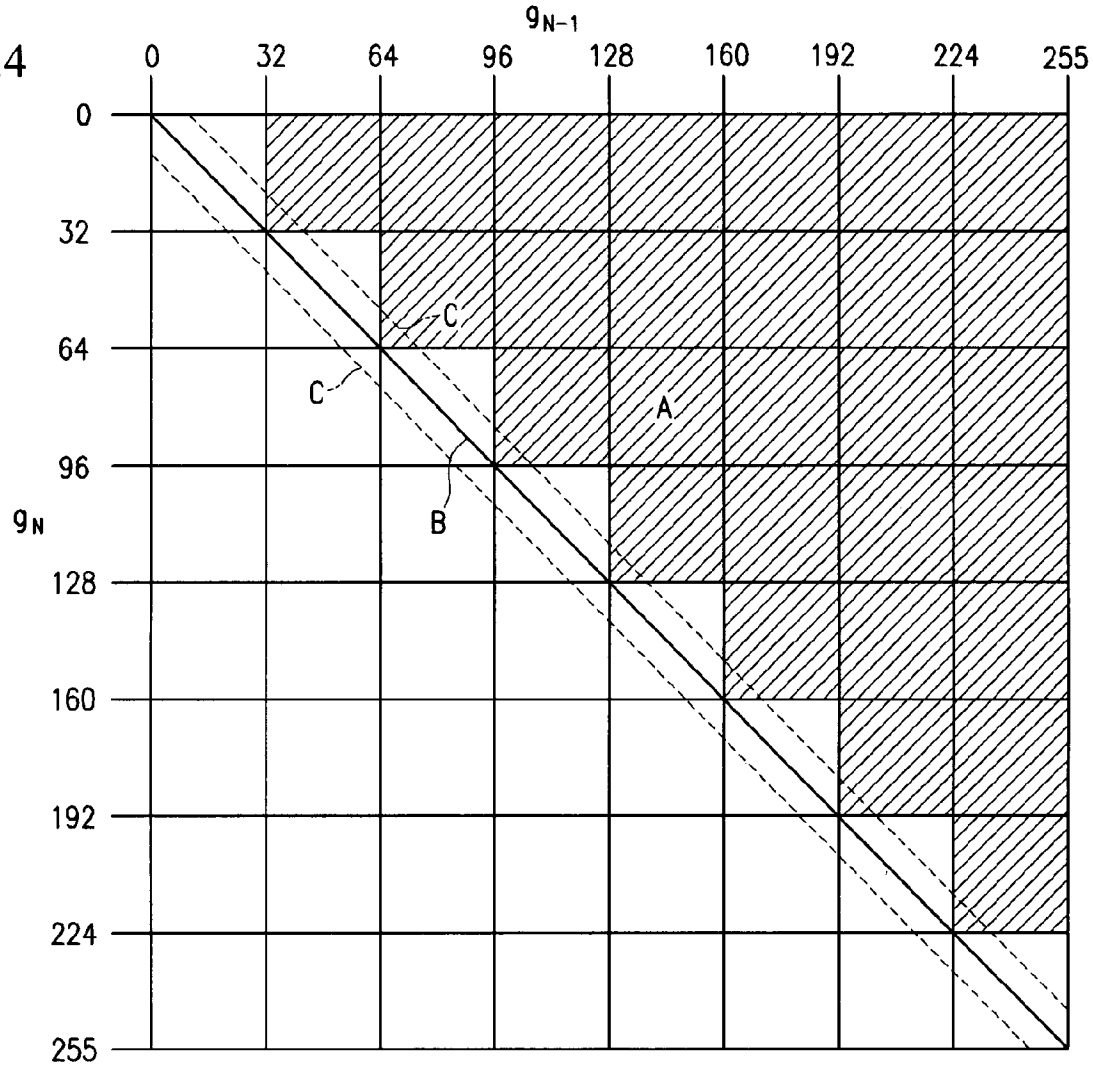
FIG. 4 illustrates a principle of the modification of the image signals according to an embodiment of the present invention.

FIG. 4 illustrates a principle of the modification of the image signals according to an embodiment of the present invention. For descriptive convenience, it will be assumed that an image signal is an 8-bit data and the bit numbers of the MSB and the LSB thereof are three and five, respectively. Accordingly, the number of gray scales or grays to be represented is $2^8=256$. Since the bit number of the MSB is smaller than that of the LSB, the size of a look-up table storing the variables as function of the MSBs of the previous image signal and the current image signal can be made small, as will be described later.

In FIG. 4, the vertical axis represents the gray of the image signals $g_N$ of the N-th frame (i.e., the "current image signals") and the horizontal axis represents the gray of the image signals $g_{N-1}$ of the (N−1)-th frame (i.e., the "previous image signals"). A combination of the current image signals and the previous image signals can be represented by a point in FIG. 4 defined by $g_N$ and $g_{N-1}$.

Since the number of gray scales is 256, there are 256×256=65,536 possible combinations of a previous image signal and a current image signal. Generating a modified signal for each of the 65,536 combinations would require not only a lot of time but also a large space in the look-up table. In accordance with the invention, the image signals to be processed are classified into groups to save time and memory space.

Possible combinations of previous image signals and current images signals are grouped into a plurality of blocks based on the MSB values of the previous image signals and the current image signals. The blocks are represented as square areas enclosed by solid lines as shown in FIG. 4. The points located on the boundaries of the blocks represent the combinations of the previous image signals $g_{N-1}$ and the current image signals $g_N$, at least one of which has zero LSB value. The previous image signals of the points inside a block are assigned a single MSB value. Likewise, the current image signals of the points located inside a block are also assigned a single MSB value. In addition, the MSB value of the points located along the left edge and the upper edge of each block is equal to that of the points inside the block, and the MSB value of the points located along the right edge and the lower edge is different from those of the points inside the block. Thus, a "block" is defined to include the points inside the rectangular area defined by four borders, the points located on the left border, and the points located on the upper border of the block. For example, the previous image signals $g_{N-1}$ (referred to as "previous MSB values" and represented as $g_{N-1}[7:5]$) for all the points located inside an arbitrary block A have an MSB value of [100], and the current image signals $g_N$ (referred to as the "current MSB values" and represented as $g_N[7:5]$) for those points have an MSB value of [010]. Orientational terms such as "upper" and "left" are herein used in reference to FIG. 4.

Modified image signals for the points located at the corners of the blocks, which have zero LSB value of the previous image signals $g_{N-1}$, the current image signals $g_N$ are first determined. The modified signals for the corners can be determined empirically to find values that cause no delay when changing images from the previous frame to the current frame.

Modified image signals for other points are then calculated using interpolation. The interpolation is applied to a point in a block based on the modified image signals for the four corners of the block. The coordinates for the four corners are represented as follows:

The first point (1)=$(g_N[7:5]\times 2^5,\ g_{N-1}[7:5]\times 2^5)$;

the second point (2)=$((g_N[7:5]+1)\times 2^5,\ g_{N-1}[7:5]\times 2^5)$;

the third point (3)=$(g_N[7:5]\times 2^5,\ (g_{N-1}[7:5]+1)\times 2^5)$; and the fourth point (4)=$((g_N[7:5]+1)\times 2^5,\ (g_{N-1}[7:5]+1)\times 2^5)$.

The reason for applying interpolation to the points in each block based on the four corners is that when the interpolation is based on fewer than all four corners, the modified image signals may be discontinuous near the block boundary. By performing an interpolation based on the four corners of the block, this discontinuity is removed.

Even if the difference between the previous gray and the current gray is small, the difference may become magnified and cause a noticeable deterioration of the image. A diagonal line B where the previous image signals $g_{N-1}$ and the current image signals $g_N$ are equal to each other represents still images. Accordingly, even a slight difference between a modified previous image signal and a modified current image signal appears on a display panel as severe noise. The previous image signals $g_{N-1}$ and the current image signals $g_N$ may be slightly different, such as for the points that lie in the regions between the diagonal line B and dotted lines C. Since it is probable that the difference is caused by noises rather than by actual changes of the images, the signal modification is not applied to the combinations that lie in these regions. This way, undesirable magnification of the difference between the signals $g_{N-1}$ and $g_N$ is avoided.

The modified image signals may be represented by equations. It is assumed that x represents the bit number of the MSB, y represents the bit number of the LSB, and a modified image signal is $g_N'$.

The modified image signal $g_N'$ is given by Equation (1):

$$g_N'=f+p\times g_N[y-1:0]/2^y-q\times g_{N-1}[y-1:0]/2^y+r\times g_N[y-1:0]\times g_{N-1}[y-1:0]/2^{2y}.$$

In Equation (1), "f" is a modified image signal for the upper left corner of the block, and is obtained by using Equation (2a):

$$f(g_N[x+y-1:y],\ g_{N-1}[x+y-1:y])=g_N'(g_N[x+y-1:y]\times 2^y,\ g_{N-1}[x+y-1:y]\times 2^y).$$

The variable "p" is a value of a modified image signal for the upper left corner subtracted from a modified image signal for the lower left corner in the block, and is given by Equation (2b):

$$\underline{p}(g_N[x+y-1:y], g_{N-1}[x+y-1:y]) = f(g_N[x+y-1:y]+1, g_{N-1}[x+y-1:y]) - f(g_N[x+y-1:y], g_{N-1}[x+y-1:y]).$$

The variable "q" is a value of a modified image signal for the upper right corner subtracted from a modified image signal for the upper left corner in the block, and is given by Equation (2c):

$$q(g_N[x+y-1:y], g_{N-1}[x+y-1:y]) = f(g_N[x+y-1:y], g_{N-1}[x+y-1:y]) - f(g_N[x+y-1:y], g_{N-1}[x+y-1:y]+1).$$

As for the variable "r," it is a value of modified image signals for the lower left corner and the upper right corner subtracted from a sum of modified image signals for the upper left corner and the lower right corner in the block, and is given by Equation (2d):

$$r(g_N[x+y-1:y], g_{N-1}[x+y-1:y]) = f(g_N[x+y-1:y]+1, g_{N-1}[x+y-1:y]+1) + f(g_N[x+y-1:y], g_{N-1}[x+y-1:y]) - f(g_N[x+y-1:y]+1, g_{N-1}[x+y-1:y]) - f(g_N[x+y-1:y], g_{N-1}[x+y-1:y]+1).$$

For the combinations including the previous image signals $g_{N-1}$ and the current image signals $g_N$ that are almost the same, that is, for the combinations in the area enclosed by the diagonal B and the dotted lines C, which satisfy a relation $|g_N-g_{N-1}|\leqq\alpha$ (where $\alpha$ is a predetermined threshold value), the modified image signals $g_N'$ are given by Equation (3):

$$g_N'=g_N.$$

Figure 5:
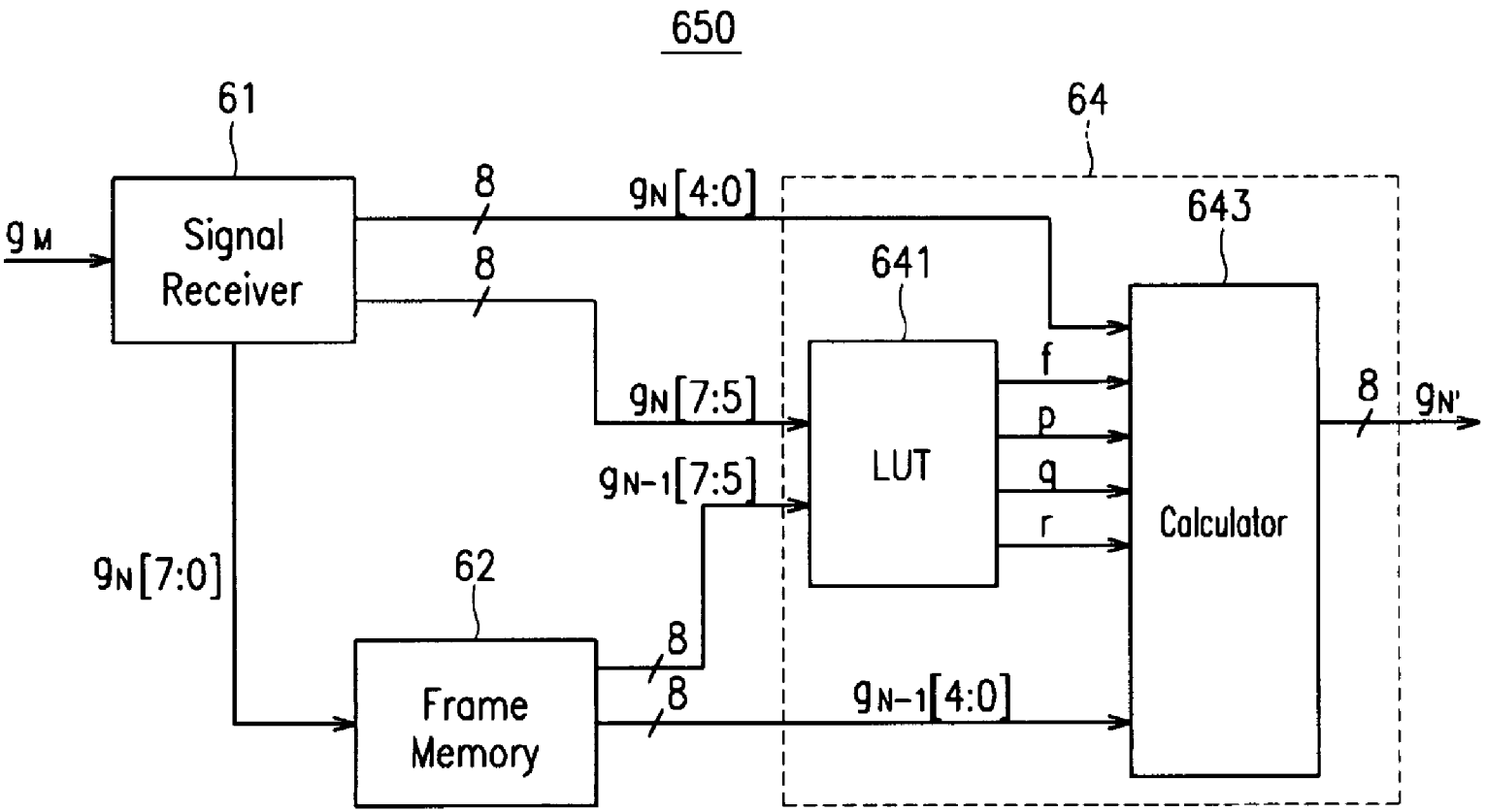
FIG. 5 is a block diagram showing an image signal modifier of an LCD according to an embodiment of the present invention.

Referring to FIG. 5, the modification of the image signals according to an embodiment of the present invention will be described in detail.

FIG. 5 is a block diagram showing an image signal modifier of an LCD according to an embodiment of the present invention. As shown in FIG. 5, the image signal modifier 650 includes a signal receiver 61, a frame memory 62 connected to the signal receiver 61, and an image signal converter connected to the signal receiver 61 and the frame memory 62. Although the image signal modifier 650 or the image signal converter 64 is included in the signal controller 600 shown in FIG. 2, it may be a stand-alone device, which may be further incorporated into an external graphics controller.

The image signal converter 64 includes a lookup table (LUT) 641 connected to the signal receiver 61 and the frame memory 62, and a calculator 643 connected to the lookup table 641, the signal receiver 61, and the frame memory 62. An output of the calculator 643 functions as an output of the image signal modifier 650.

Upon receiving an input image signal $g_M$ from a signal source (not shown), the signal receiver 61 of the image signal modifier 650 shown in FIG. 5 converts the input image signal $g_M$ into another input image signal $g_N$ so that the converted image signal $g_N$ can be processed by the image signal modifier 650. The signal receiver 61 provides the converted image signal $g_N$ as a current image signal for the frame memory 62 and the image signal converter 64.

The frame memory 62 provides a previous image signal $g_{N-1}$ stored therein for the image signal converter 64 and stores the current image signal $g_N$ from the signal receiver 61 as a previous image signal $g_{N-1}$.

The image signal converter 64 generates a modified image signal $g_N'$ based on the current image signal $g_N$ supplied from the signal receiver 61 and the previous image signal $g_{N-1}$ supplied from the frame memory 62 and outputs the modified image signal $g_N'$.

The image signal $g_N$ from the signal receiver 61 is divided into the MSB ($g_N[7:5]$) and the LSB ($g_N[4:0]$) to be supplied for the image signal converter 64. Similarly, the image signal $g_{N-1}$ from the frame memory 62 is divided into the MSB ($g_{N-1}[7:5]$) and the LSB ($g_{N-1}[4:0]$) to be supplied for the image signal converter 64. The MSBs ($g_N[7:5]$, $g_{N-1}[7:5]$) are provided for the lookup table 641, and the LSBs ($g_N[4:0]$, $g_{N-1}[4:0]$) are provided for the calculator 643.

As described above, four variables f, p, q and r determined by the modified image signals for four vertexes of each block shown in FIG. 4, i.e., for the case that both the current LSB and the previous LSB are zero are stored in the lookup table 641 of the image signal converter 64.

Because the image signals are 8-bit data, and the bit numbers of the MSB and the LSB is three and four, respectively, the variables f, p, q and r are determined as:

$$f(g_N[7:5], g_{N-1}[7:5]) = g_N'(g_N[7:5]\times 2^5, g_{N-1}[7:5]\times 2^5) \quad \text{(Eq. 4a)}$$

$$p(g_N[7:5], g_{N-1}[7:5]) = f(g_N[7:5]+1, g_{N-1}[7:5]) - f(g_N[7:5], g_{N-1}[7:5]) \quad \text{(Eq. 4b)}$$

$$q(g_N[7:5], g_{N-1}[7:5]) = f(g_N[7:5], g_{N-1}[7:5]) - f(g_N[7:5], g_{N-1}[7:5]+1) \quad \text{(Eq. 4c)}$$

$$r(g_N[7:5], g_{N-1}[7:5]) = f(g_N[7:5]+1, g_{N-1}[7:5]+1) + f(g_N[7:5], g_{N-1}[7:5]) - f(g_N[7:5]+1, g_{N-1}[7:5]) - f(g_N[7:5], g_{N-1}[7:5]+1). \quad \text{(Eq. 4d)}$$

The lookup table 641 fetches and supplies the stored values of the variables f, p, q and r for the calculator 643.

The calculator 643 calculates the modified image signal $g_N'$ using the values of the variables f, p, q and r supplied from the lookup table 641, the previous LSB ($g_{N-1}[4:0]$) supplied from the frame memory 62, and the current LSB ($g_N[4:0]$) supplied from the signal receiver 61 as follows:

$$g_N'=f+p\times g_N[4:0]/2^5-q\times g_{N-1}[4:0]/2^5+r\times g_N[4:0]\times g_{N-1}[4:0]/2^{10} \quad \text{(Eq. 5)}$$

At this time, the number right to the decimal point is rounded off or cut off.

In the meantime, it is preferable that the values of the variables f, p, q, and r obtained by experiments and the above-described equations are exactly stored in data having sufficiently large bit number to obtain optimized modification. For example, the values of the variable f are stored as unsigned 8-bit data, and the values of the variables p, q and r are stored as signed 8-bit data. Then, the total bit number occupied by the values of the variables f, p, q and r is 8×4=32. Since the bit number of the MSBs ($g_N[7:5]$, $g_{N-1}[7:5]$) of the image signals $g_N$ and $g_{N-1}$ is 3 and thus the number of cases in the combinations of the current image signals $g_N$ and the previous image signals $g_{N-1}$ is $2^3 \times 2^3$, the data stored in the lookup table 641 are equal to 8×8×32=2,048 bits.

For comparison, it is assumed that the MSBs are 4-bit data. Then, the values of the variable f may be stored as unsigned 8-bit data, the values of the variable p may be stored as unsigned 8-bit data, the values of the variable q may be stored as unsigned 5-bit data, and the values of the variable r may be stored as signed 5-bit data. Accordingly, the data stored in the lookup table 641 are equal to $2^4 \times 2^4 \times (8+6+5+5) = 16 \times 16 \times 24 = 6{,}144$ bits.

As a result, the data stored in the lookup table 641 for 3-bit MSBs according to this embodiment are about one third of those for 4-bit MSBs.

In addition, the number of the values of the variable f for 3-bit MSBs is 8×8=64, while that for 4-bit MSBs is 16=16=256. Since the values of the variable f are determined by experiments, the number of experiments for 3-bit MSBs is much smaller than that for 4-bit MSBs and thus time and efforts for obtaining the values of the variable f are reduced.

Furthermore, since the values of the variables p, q and r for the 4-bit MSB modification cannot be exact due to the limited bit numbers thereof, the 4-bit MSB modification based on 4-bit MSBs may not be optimized compared with the 3-bit MSB modification.

As described above, the modified image signals, i.e., the values of the variable f for the corners, are determined by experiments such that there is no delay in changing images from the previous frame to the current frame.

TABLE 1 and 2 illustrate examples of the modified signals for the corners.

TABLE 1

| | $g_{N-1}$ | | | | | | | | |
|---|---|---|---|---|---|---|---|---|---|
| $g_N$ | 0 | 32 | 64 | 96 | 128 | 160 | 192 | 224 | 255 |
| 0 | 0 | 0 | 0 | 0 | 0 | 0 | 0 | 0 | 0 |
| 32 | 115 | 32 | 22 | 20 | 15 | 15 | 15 | 15 | 15 |
| 64 | 169 | 103 | 64 | 50 | 34 | 27 | 22 | 20 | 16 |
| 96 | 192 | 146 | 118 | 96 | 87 | 70 | 54 | 36 | 29 |
| 128 | 213 | 167 | 156 | 143 | 128 | 121 | 105 | 91 | 70 |
| 160 | 230 | 197 | 184 | 179 | 174 | 160 | 157 | 147 | 129 |
| 192 | 238 | 221 | 214 | 211 | 205 | 199 | 192 | 187 | 182 |
| 224 | 250 | 245 | 241 | 240 | 238 | 238 | 224 | 224 | 222 |
| 255 | 255 | 255 | 255 | 255 | 255 | 255 | 255 | 255 | 255 |

TABLE 2

| | $g_{N-1}$ | | | | | | | | |
|---|---|---|---|---|---|---|---|---|---|
| $g_N$ | 0 | 32 | 64 | 96 | 128 | 160 | 192 | 224 | 255 |
| 0 | 0 | 34 | 34 | 34 | 34 | 33 | 33 | 32 | 32 |
| 32 | 115 | 32 | 35 | 35 | 35 | 34 | 34 | 33 | 33 |
| 64 | 169 | 103 | 64 | 67 | 67 | 67 | 67 | 66 | 66 |
| 96 | 192 | 146 | 118 | 96 | 97 | 97 | 97 | 97 | 97 |
| 128 | 213 | 167 | 156 | 143 | 128 | 128 | 128 | 128 | 128 |
| 160 | 230 | 197 | 184 | 179 | 174 | 160 | 160 | 160 | 160 |
| 192 | 238 | 221 | 214 | 211 | 205 | 199 | 192 | 192 | 192 |
| 224 | 250 | 245 | 241 | 240 | 238 | 238 | 224 | 224 | 224 |
| 255 | 255 | 255 | 255 | 255 | 255 | 255 | 255 | 255 | 255 |

Referring to TABLE 1, the modified image signal $g_N'$ is smaller than the current image signal $g_N$ when the current image signal $g_N$ is smaller than the previous signal $g_{N-1}$, (i.e., when the image signal decreases). On the contrary, the modified image signal $g_N'$ is larger than the current image signal $g_N$ when the current image signal $g_N$ is larger than the previous image signal $g_{N-1}$.

However, the modified image signal $g_N'$ is always equal to or larger than the pre-modified image signal $g_N$ in the case shown in TABLE 2. In other words, the modified image signals $g_N'$ for the corners of the blocks disposed above the diagonal line B are determined in an opposite manner compared with that shown in TABLE 1. Then, the modified image signal $g_N'$ calculated by Equation 5 is always larger than the current image signals $g_N$ since all the modified image signals $g_N'$ for the four corners in a block are larger than the current image signals $g_N$ and the modified signals $g_N'$ are continuous in the block.

For example, it is considered a point in the block A shown in FIG. 4, which includes a current image signal $g_N$ equal to 87=[01010111] and a previous image signal $g_{N-1}$ equal to 147=[10010011]. Then, the current MSB ($g_N[7:5]$) is [010]=2, the previous MSB ($g_{N-1}[7:5]$) is [100]=4, the current LSB ($g_N[4:0]$) is [10111]=23, and the previous LSB ($g_{N-1}[4:0]$) is [10011]=19.

The values of the variables f, p, q, and r are determined from TABLE 2 and Equations 6a-6d as follows:

$$f(2,4) = g_N'(g_N = 64, g_{N-1} = 128) = 67 \quad \text{(Eq. 6a)}$$

$$\begin{aligned} p(2,4) &= f(3,4) - f(2,4) \quad \text{(Eq. 6b)} \\ &= g_N'(g_N = 96, g_{N-1} = 128) - \\ &\quad g_N'(g_N = 64, g_{N-1} = 128) \\ &= 97 - 67 \\ &= 30 \end{aligned}$$

$$\begin{aligned} q(2,4) &= f(2,4) - f(2,5) \quad \text{(Eq. 6c)} \\ &= g_N'(g_N = 64, g_{N-1} = 128) - \\ &\quad g_N'(g_N = 64, g_{N-1} = 160) \\ &= 67 - 67 \\ &= 0 \end{aligned}$$

$$\begin{aligned} r(2,4) &= f(3,5) + f(2,4) - f(3,4) - f(2,5) \quad \text{(Eq. 6d)} \\ &= g_N'(g_N = 96, g_{N-1} = 160) + \\ &\quad g_N'(g_N = 64, g_{N-1} = 128) - \\ &\quad g_N'(g_N = 96, g_{N-1} = 128) - \\ &\quad g_N'(g_N = 64, g_{N-1} = 160) \\ &= 97 + 67 - 97 - 67 \\ &= 0 \end{aligned}$$

Accordingly, the modified image signal $g_N'$ is given by Equation 6 as follows:

$$g_N' = f + p \times g_N[4:0]/2^5 - q \times g_{N-1}[4:0]/2^5 + r \times g_N[4:0] \times g_{N-1}[4:0]/2^{10} \quad (7)$$

-continued $$= 67 + 30 \times 23/32 - 0 \times 19/32 - 0 \times 23 \times 19/1024$$

$$= 88.5625$$

Cutting off or rounding off the numbers to the right of the decimal point yields the modified image signal $g_N'$ having a gray equal to 88 or 89. Therefore, the modified image signal $g_N'$ is larger than the current image signal $g_N$.

Luminance levels of an LCD modifying the image signals based on the values in TABLE 1 and TABLE 2 were measured at different times.

Figure 6A:
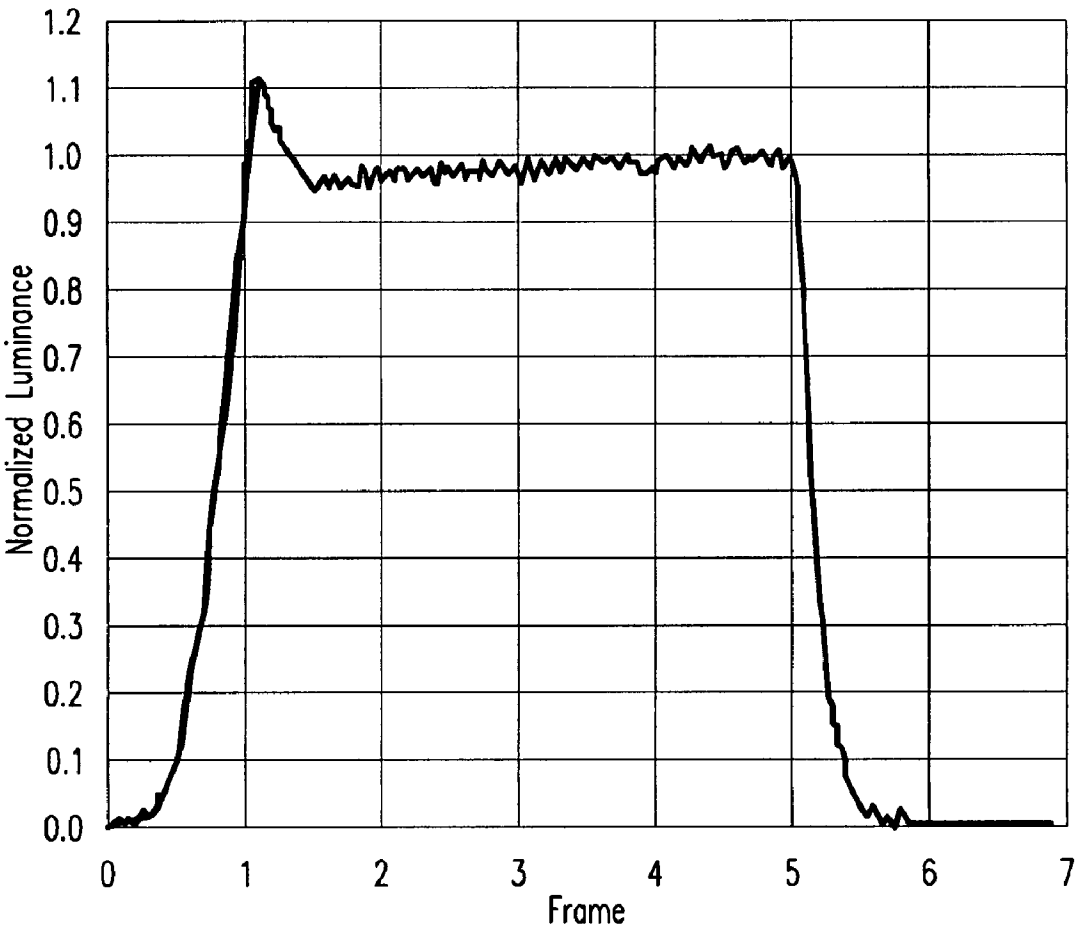
FIGS. 6A and 6B are graphs illustrating the time variance of the luminance for the modification based on TABLE 1 and TABLE 2, respectively.
Figure 6B:
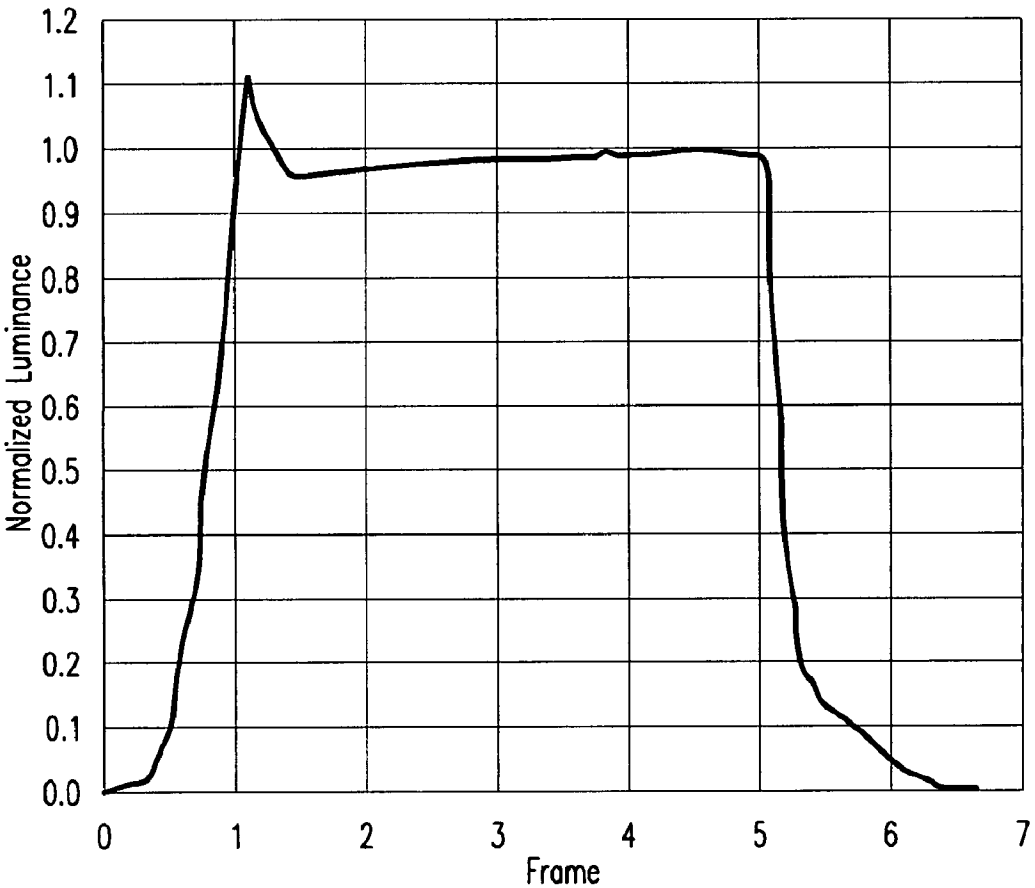

FIG. 6A is a graph illustrating the luminance for the modification based on TABLE 1 as a function of time, and FIG. 6B is a graph illustrating the luminance for the modification based on TABLE 2 as a function of time. The LCD was first supplied with an image signal having a gray equal to zero to stabilize the luminance, and then it was supplied five times with an image signal having a gray equal to "128" and supplied once with an image signal having a gray equal to zero. It is noted that the vertical axis represents normalized luminance.

For the modification based on TABLE 1, flickering was observed, as shown in FIG. 6A by the small and continuous luminance fluctuation starting at Frame 1.5 and ending at about Frame 5. However, as shown in FIG. 6B, there was no flickering for the modification based on TABLE 2.

This phenomenon is generated due to the difference between the rising time and the falling time of liquid crystal molecules. The rising time and the falling time are defined as the time required for the normalized luminance level to increase from 10% to 90% and vice versa, respectively. Generally, the falling time is shorter than the rising time when the image signals are supplied in the above-described pattern, particularly for a vertical alignment (VA) mode LCD where the liquid crystal molecules are aligned vertical to the surfaces of the panels in the absence of electric field. The difference may be further severe for a patterned VA (PVA) mode LCD including pixel electrodes 190 having a plurality of cutouts.

Accordingly, the decreasing modification of the image signal for the falling of the liquid crystal molecules (or for the decreasing transition of the gray) as shown in TABLE 1, which magnifies the difference between the current image signal and the previous image signal, further shortens the falling time to increase the difference between the rising time and the falling time.

On the contrary, the increasing modification of the image signals for the falling of the liquid crystal molecules as shown in TABLE 2, which reduces the difference between the current image signal and the previous image signal, elongates the falling time to decrease the difference between the rising time and the falling time.

The rising times for both the cases shown in FIGS. 6A and 6B were equal to about 0.6 frames. However, the falling time for the case shown in FIG. 6A is equal to about 0.3, while that shown in FIG. 6B was equal to about 0.6. Accordingly, although the modification illustrated in TABLE 1 and FIG. 6A caused the wire frame flickering since the rising time is different from the falling time, the modification illustrated in TABLE 2 and FIG. 6B did not cause such a flickering because the rising time and the falling time are equal.

Considering the above-described results, the wire frame flickering can be prevented by determining the modified image signals for the corners of the blocks shown in FIG. 4, i.e., selecting the value of the variable f so that the rising time and the falling time of the liquid crystal molecules are equal.

In summary, the modification according to the embodiments modifies an image signal to have increased gray based on 3-bit MSB and 5-bit LSB. Therefore, the wire frame flickering is reduced, the size of the lookup table is decreased, and the modified image signal is optimized.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method of driving a display device, the method comprising:

determining a previous image's gray signal $g_{N-1}$ corresponding to an (N−1)th frame;

determining a current image's gray signal $g_N$ corresponding to an Nth frame;

selecting a modified signal $g'_N$ from a set of predetermined modified signal values by using $g_{N-1}$ and $g_N$, wherein each of the predetermined modified signal values is selectable for a range of $g_{N-1}$ and $g_N$; and applying the modified signal $g'_N$ to data lines in the display device to elongate a falling time of liquid crystal molecules, wherein $g'_N$ is larger than or equal to $g_N$ when $g_N < g_{N-1}$.

2. The method of claim 1 further comprising setting $g'_N$ equal to $g_N$ if a difference between $g_N$ and $g_{N-1}$ is less than a threshold value.

3. The method of claim 1, wherein each predetermined modified signal value in the set has a first predefined most-significant-bit value for the $g_{N-1}$ and a second predefined most-significant-bit value for the $g_N$.

4. The method of claim 1 further comprising calculating the modified signal value $g'_N$.

5. The method of claim 4, wherein the calculating of the modified signal value $g'_N$ comprises:

mapping a grid on a plot having $g_N$ as a first axis and $g_{N-1}$ as a second axis, wherein the grid has blocks that span a range of $g_N$ and a range of $g_{N-1}$;

selecting a block defined by four corners;

determining modified signal values for the four corners; and interpolating the modified signal values for the four corners to determine coordinates for points inside the block.

6. The method of claim 5, wherein the modified signal value $g'_N$ is determined using the formula $$g'_N = f + p \times g_N[y-1:0]/2^y - q \times g_{N-1}[y-1:0]/2^y + r \times g_N[y-1:0] \times g_{N-1}[y-1:0]/2^{2y},$$

$$\text{where } f(g_N[x+y-1:y], g_{N-1}[x+y-1:y]) = g'_N(g_N[x+y-1:y] \times 2^y, g_{N-1}[x+y-1:y] \times 2^y);$$

$$\underline{p}(g_N[x+y-1:y], g_{N-1}[x+y-1:y]) = f(g_N[x+y-1:y]+1, g_{N-1}[x+y-1:y]) - f(g_N[x+y-1:y], g_{N-1}[x+y-1:y]);$$

$$q(g_N[x+y-1:y], g_{N-1}[x+y-1:y]) = f(g_N[x+y-1:y], g_{N-1}[x+y-1:y]) -$$

-continued $$f(g_N[x+y-1:y],\ g_{N-1}[x+y-1:y]+1);$$

$$\text{and } r(g_N[x+y-1:y],\ g_{N-1}[x+y-1:y]) =$$

$$f(g_N[x+y-1:y]+1,\ g_{N-1}[x+y-1:y]+1)+$$

$$f(g_N[x+y-1:y],\ g_{N-1}[x+y-1:y])-f(g_N[x+y-1:y]+1,$$

$$g_{N-1}[x+y-1:y])-f(g_N[x+y-1:y],\ g_{N-1}[x+y-1:y]+1)$$

wherein x represents a bit number of the most significant bit and y represents the bit number of the least significant bit.

7. The method of claim 6 further comprising storing the values of f, p, q, and r in a memory, wherein the f is stored as unsigned 8-bit data and p, q and r are stored as signed 8-bit data.

8. The method of claim 5, wherein each of the previous image's gray signal $g_{N-1}$, the current image's gray signal $g_N$, and the modified signal $g'_N$ is an 8-bit signal with three most significant bits and five least significant bits.

9. A method of driving a display device, the method comprising:

determining a previous image's gray signal $g_{N-1}$ corresponding to an (N−1)th frame;

determining a current image's gray signal $g_N$ corresponding to an Nth frame;

selecting a modified signal g'N from a set of predetermined modified signal values by using $g_{N-1}$ and $g_N$, such that $g'_N$ is larger than or equal to $g_N$ when $g_N<g_{N-1}$; and applying the modified signal $g'_N$ to data lines in the display device to elongate a falling time of liquid crystal molecules.

10. A display device comprising:

a display panel having pixels defined by data lines and gate lines;

an image signal modifier for receiving a previous image's gray signal $g_{N-1}$ from a frame memory and a current image's gray signal $g_N$ from a signal receiver, and selecting a modified signal $g'_N$ from a set of predetermined modified signal values by using $g_{N-1}$ and $g_N$, wherein each of the predetermined modified signal values is selectable for a range of $g_N$ and $g_{N-1}$; and a data driver for applying the modified signal $g'_N$ to the data lines to elongate a falling time of liquid crystal molecules, wherein $g'_N$ is larger than or equal to $g_N$ when $g_N<g_{N-1}$.

11. The display device of claim 10, wherein the image signal modifier accesses the set of predetermined modified signal values from a look-up table.

12. The display device of claim 10, wherein the selected modified signal g'N is greater than the current image's gray signal $g_N$.

13. The display device of claim 10, wherein the image signal modifier sets g'N equal to gN if a difference between gN and $g_{N-1}$ is less than a threshold value.

14. The display device of claim 10, wherein each predetermined modified signal value in the set has a first predefined most-significant-bit value for the $g_{N-1}$ and a second predefined most-significant-bit value for the $g_N$.

15. The display device of claim 10, wherein each of the previous image's gray signal $g_{N-1}$, the current image's gray signal $g_N$, and the modified signal $g'_N$ is an 8-bit signal with three most significant bits and five least significant bits.

16. The display device of claim 10 further comprising a frame memory for storing the previous image's gray signal $g_{N-1}$.

17. The display device of claim 10 further comprising a signal controller that feeds control signals to the data driver, wherein the image signal modifier is part of the signal controller.

18. The display device of claim 10, wherein the display device is a vertical alignment (VA) liquid crystal display device.

19. The display device of claim 10, wherein the display device is a patterned vertical alignment (PVA) liquid crystal display device.

* * * * *